US006722670B1

(12) United States Patent
Lee

(10) Patent No.: US 6,722,670 B1
(45) Date of Patent: Apr. 20, 2004

(54) ROLLER SKATE PROVIDED WITH MEANS TO ABSORB SHOCK

(76) Inventor: Yan-Yee Lee, 16, Lane 667, Chang Shang Road, Sir Nan Village, Sun Kang Hsiang, Taichung Hsien (TW)

( * ) Notice: Subject to any disclaimer, the term of this patent is extended or adjusted under 35 U.S.C. 154(b) by 0 days.

(21) Appl. No.: 10/174,963

(22) Filed: Jun. 20, 2002

(51) Int. Cl.[7] ..... A63C 17/00

(52) U.S. Cl. ..... 280/11.19; 280/11.225; 280/11.28

(58) Field of Search ..... 280/11.225, 11.28, 280/11.204, 11.19, 11.207, 11.216, 11.27, 11.208

(56) References Cited

U.S. PATENT DOCUMENTS

| | | | | | |
|---|---|---|---|---|---|
| 829,900 | A | * | 8/1906 | Shelmire | 280/11.216 |
| 892,164 | A | * | 6/1908 | King | 280/11.26 |
| 983,970 | A | * | 2/1911 | Zamboni | 280/11.27 |
| 2,195,348 | A | * | 3/1940 | Wiseley | 280/11.26 |
| 2,676,812 | A | * | 4/1954 | Owsen et al. | 280/11.28 |
| 3,653,678 | A | * | 4/1972 | Collett | 280/11.225 |
| 3,774,924 | A | * | 11/1973 | Machatsch | 280/11.28 |
| 4,402,521 | A | * | 9/1983 | Mongeon | 280/11.225 |
| 5,904,360 | A | * | 5/1999 | Oliemans et al. | 280/11.28 |

FOREIGN PATENT DOCUMENTS

| | | | |
|---|---|---|---|
| AT | 36377 | * | 2/1909 |
| AT | 52982 | * | 4/1912 |
| DE | 654100 | * | 12/1937 |
| DE | 182072 | * | 5/1955 |

* cited by examiner

*Primary Examiner*—Bryan Fischmann
(74) *Attorney, Agent, or Firm*—Harrison & Egbert

(57) ABSTRACT

A roller skate includes a boot, a connection frame fastened to the outsole of the boot, an expandable frame fitted with the connection frame, a wheel frame fastened to the connection frame and provided with a plurality of wheels and a brake shoe, and an elastic member located in the connection frame by the expandable frame. The elastic member serves as a shock absorber of the roller skate.

6 Claims, 12 Drawing Sheets

ROLLER SKATE PROVIDED WITH MEANS TO ABSORB SHOCK

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a roller skate, and more particularly to a roller skate which is provided with a shock-absorbing device to mitigate the transmission of shock wave from the roller skate to the head of a person who glides on a hardwood floor, sidewalk, and the like.

BACKGROUND OF THE INVENTION

As shown in FIG. 1, the conventional roller skate comprises a boot 10, a sole plate 11, and a plurality of wheels 12 which are pivotally fastened to the sole plate 11. The sole plate 11 is fastened to the outsole of the boot 10. When a person wears the conventional roller skates to glide on a hard surface, the shock wave is easily transmitted to the boot 10 from the wheels 12. This is due to the fact that the conventional roller skate is devoid of a shock-absorbing device. The shock wave is often transmitted to the head of a wearer of the conventional roller skate. In other words, the wearer of the conventional roller skate can feel the mechanical friction between the wheels 12 and the surface on which the wheels 12 glide. As a result, it is rather uncomfortable for a person to wear the conventional roller skate to glide on a hard surface.

BRIEF SUMMARY OF THE INVENTION

The primary objective of the present invention is to provide a roller skate with a shock-absorbing device, so as to make the roller skating a comfortable and pleasant sport.

In keeping with the principle of the present invention, the foregoing objective of the present invention is attained by a roller skate comprising a boot, a wheel frame, a connection frame located between the boot and the wheel frame, an expandable frame fitted around the connection frame, and an elastic member disposed in the connection frame to serve as a shock-absorbing device to prevent the transmission of shock wave from the wheels to the boot.

The features and the advantages of the present invention will be more readily understood upon a thoughtful deliberation of the following detailed description of the preferred embodiments of the present invention with reference to the accompanying drawings.

DETAILED DESCRIPTION OF THE INVENTION

Figure 1:
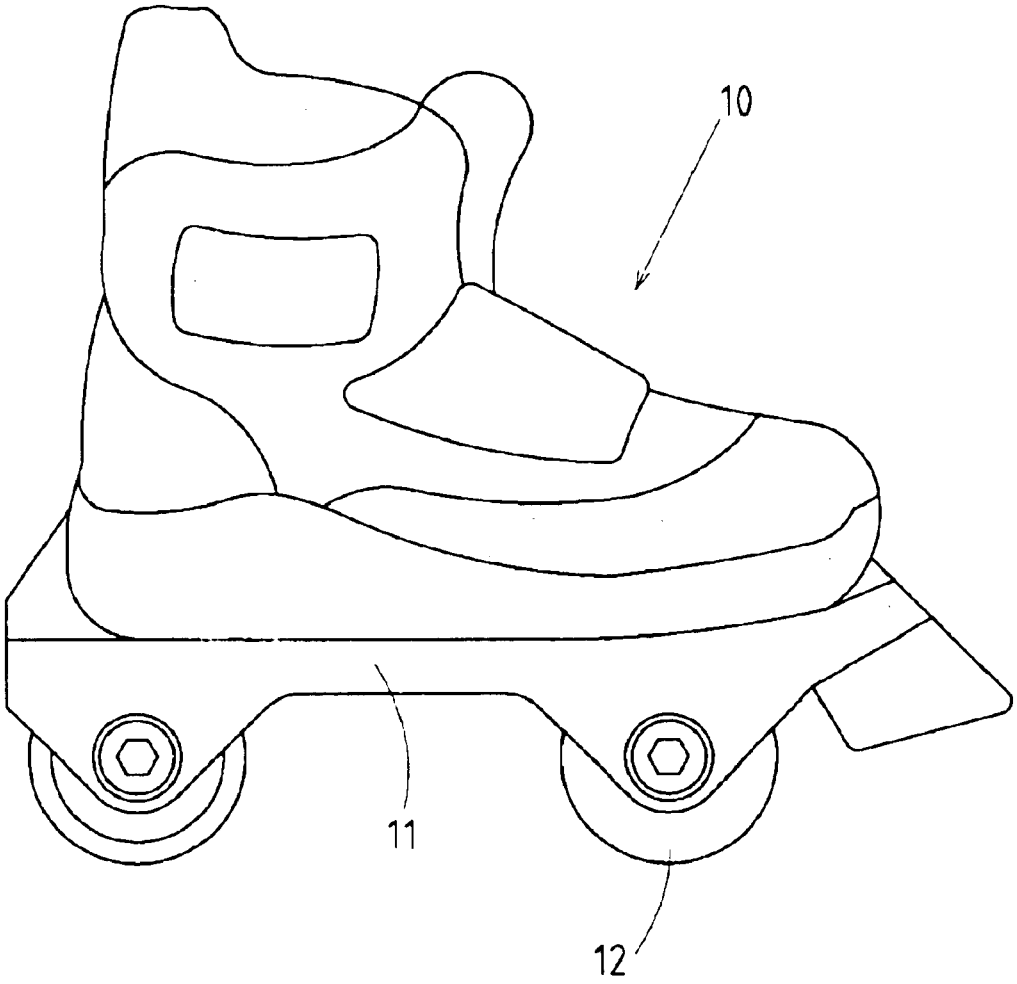
FIG.1 PRIOR ART
FIG. 1 shows a schematic side view of a roller skate of the prior art.
Figure 2:
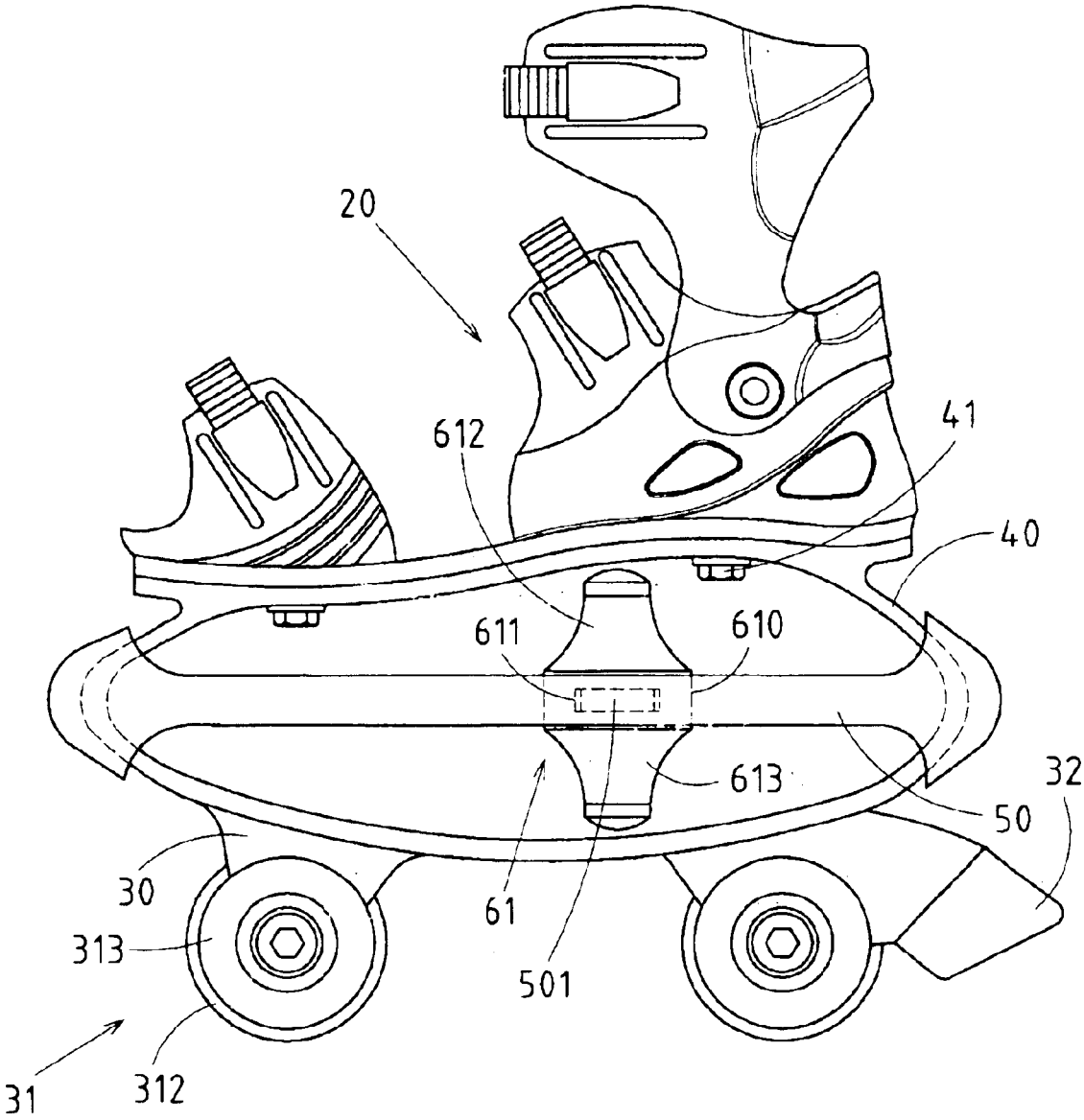
FIG. 2 shows a schematic side view of a first preferred embodiment of the present invention.
Figure 3:
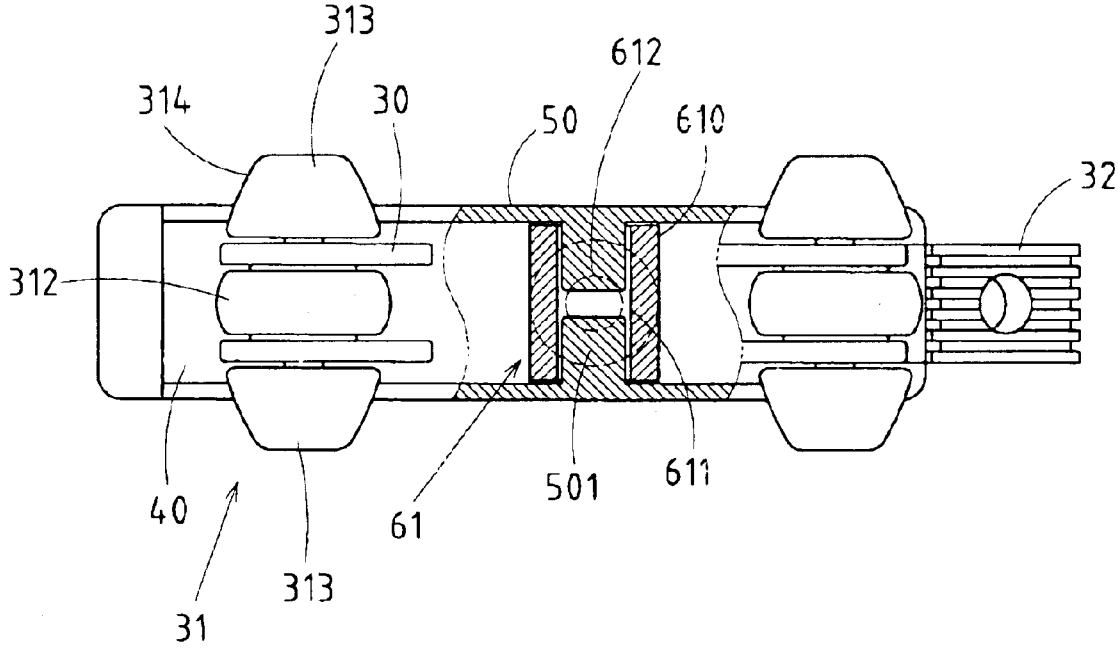
FIG. 3 shows a sectional schematic view of an elastic member of the first preferred embodiment of the present invention.

As shown in FIGS. 2 and 3, a roller skate of the first preferred embodiment of the present invention comprises a boot 20, a wheel frame 30, a connection frame 40, an expandable frame 50, and an elastic member 61.

The connection frame 30 is fastened to the outsole of the boot 20 by means of a plurality of fastening bolts 41.

The wheel frame 30 is fastened to the connection frame 30 and is provided with a plurality of wheels 31 and a brake shoe 32.

The expandable frame 50 is fitted around the periphery of the connection frame 40 to provide the connection frame 40 with a recovery force.

The elastic member 61 is mounted in the connection frame 40 such that the top end and the bottom end of the elastic member 61 may be in contact with the connection frame 40, or may be separated from the connection frame 40 by an interval. The elastic member 61 of the first preferred embodiment of the present invention is a rubber block 61 having a main body 610 which is provided in the center with a through slot 611. The expandable frame 50 is provided with a locating piece 501 which is inserted into the through slot 611 to locate the rubber block 61 such that a top end 612 and a bottom end 613 of the rubber block 61 come in contact with the connection frame 40 or separate from the connection frame 40 by a distance.

Figure 4:
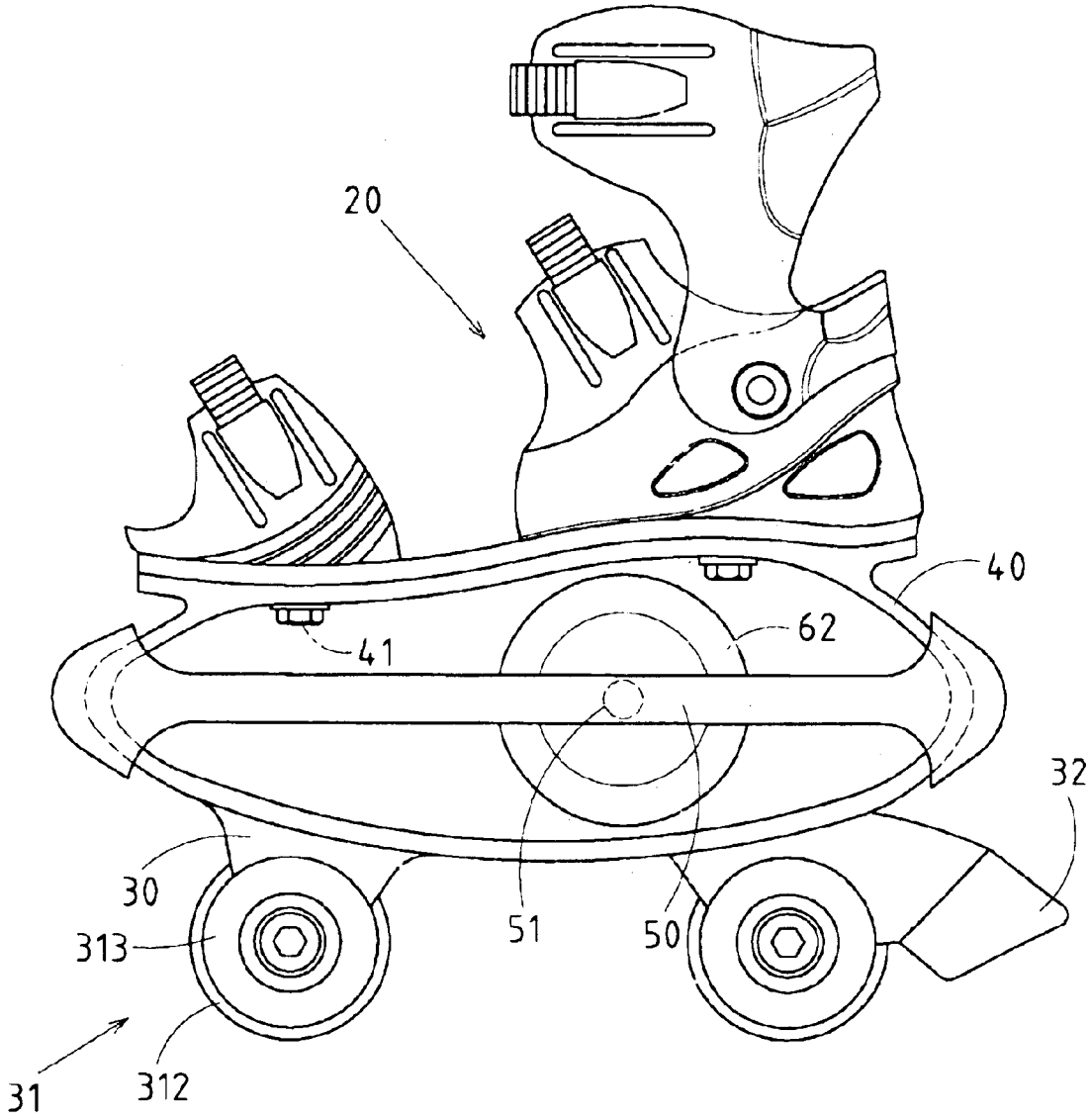
FIG. 4 shows a schematic side view of a second preferred embodiment of the present invention.
Figure 5:
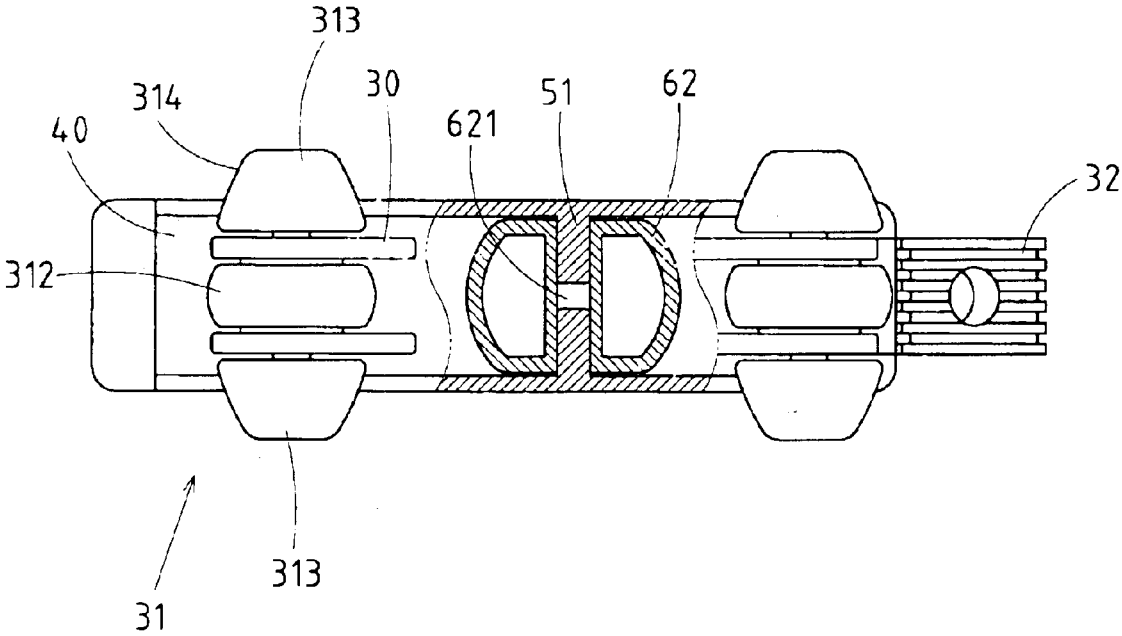
FIG. 5 shows a sectional schematic view of an elastic member of the second preferred embodiment of the present invention.

As shown in FIGS. 4 and 5, a roller skate of the second preferred embodiment of the present invention is basically similar in construction to that of the first preferred embodiment described above, except that the former comprises an elastic member which is a rubber wheel 62. The rubber wheel 62 is provided with a locating hole 621. The expandable frame 50 is provided with a locating pillar 51, which is inserted into the locating hole 621 of the rubber wheel 62 so as to locate the rubber wheel 62 in the connection frame 40 in such a manner that the rim of the rubber wheel 62 may or may not be in contact with the connection frame 40.

Figure 6:
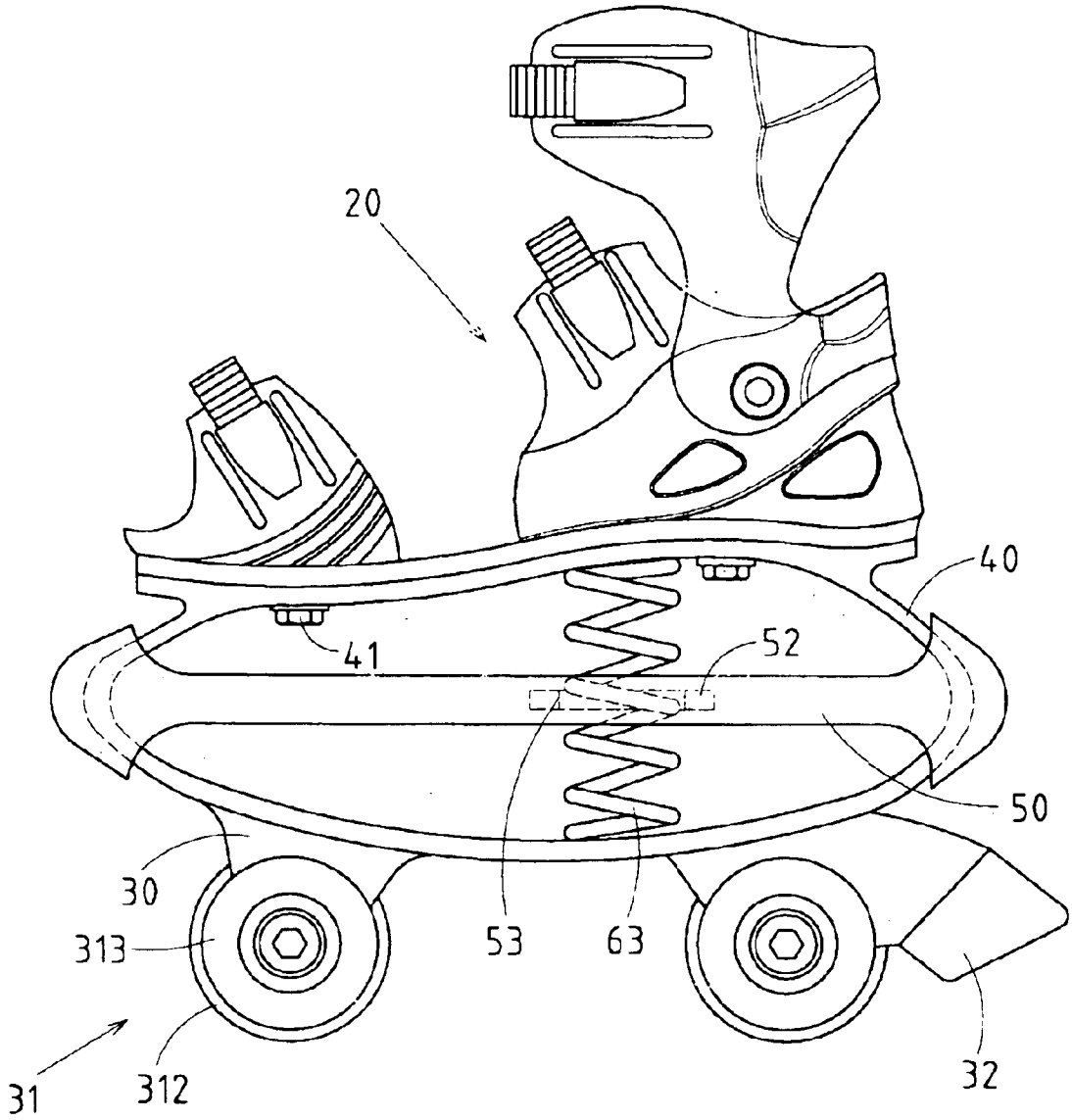
FIG. 6 shows a side schematic view of a third preferred embodiment of the present invention.
Figure 7:
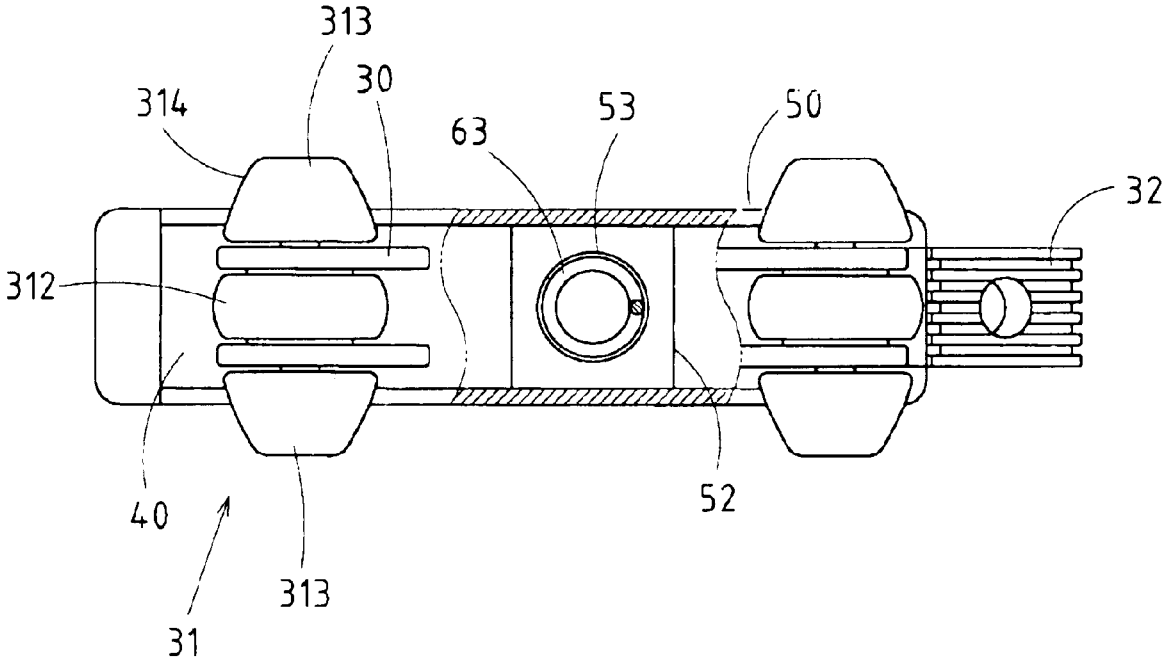
FIG. 7 shows a sectional schematic view of an elastic member of the third preferred embodiment of the present invention.

As shown in FIGS. 6 and 7, a roller skate of the third preferred embodiment of the present invention is basically similar in construction to that of the first preferred embodiment, except that the former comprises an elastic member, which is a coil spring 63. The coil spring 63 is located in the connection frame 40 by the expandable frame 50 such that both ends of the coil spring 63 come in contact with the connection frame 40, and that the coil spring 63 is confined in a through hole 53 of a locating plate 52 of the expandable frame 50.

Figure 8:
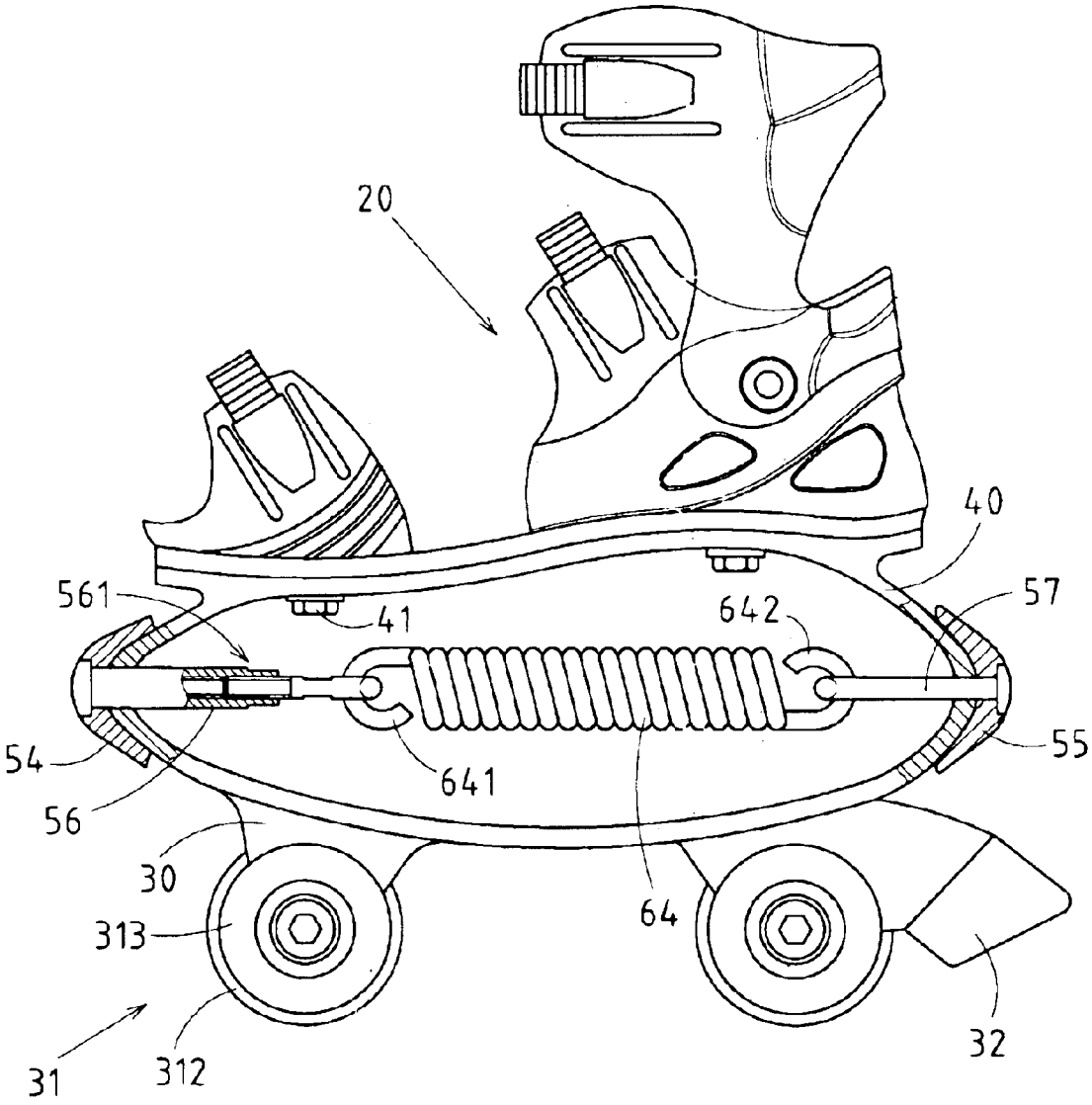
FIG. 8 shows a side schematic view of a fourth preferred embodiment of the present invention.
Figure 9:
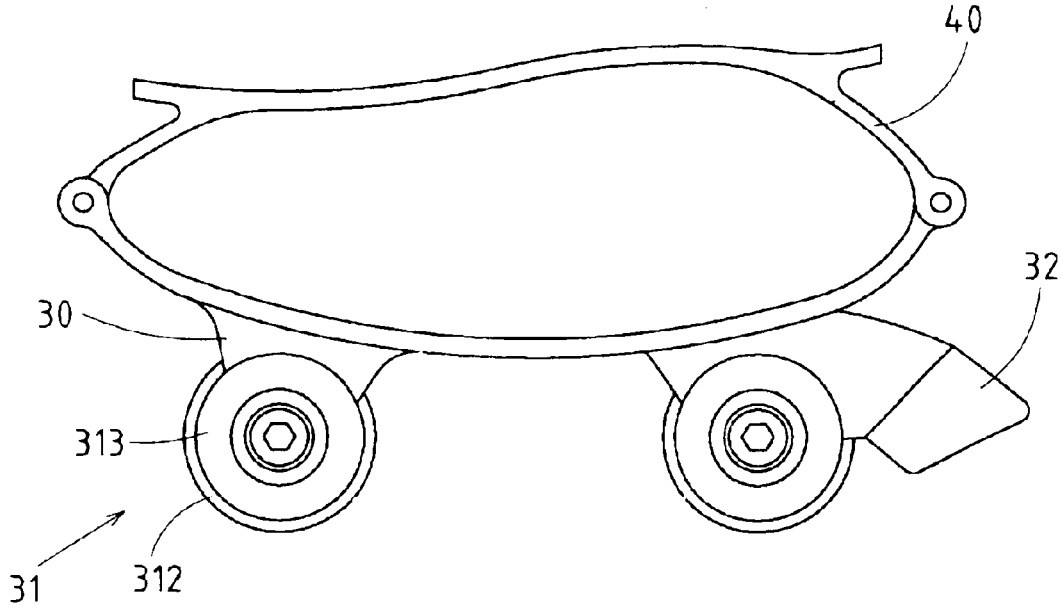
FIGS. 9–13 are schematic views of various connection frames of the present invention.
Figure 10:
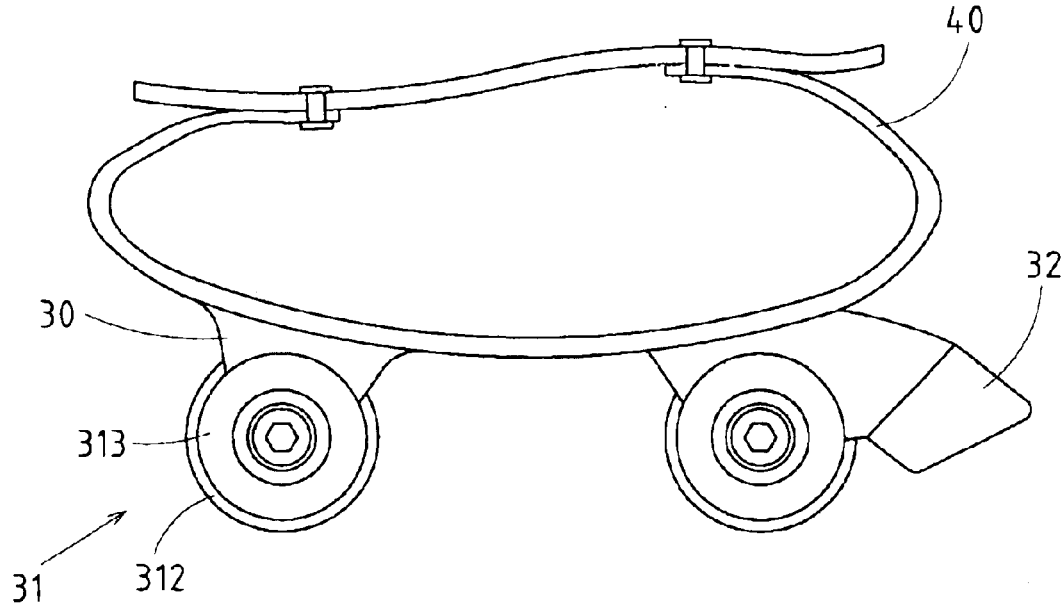
Figure 11:
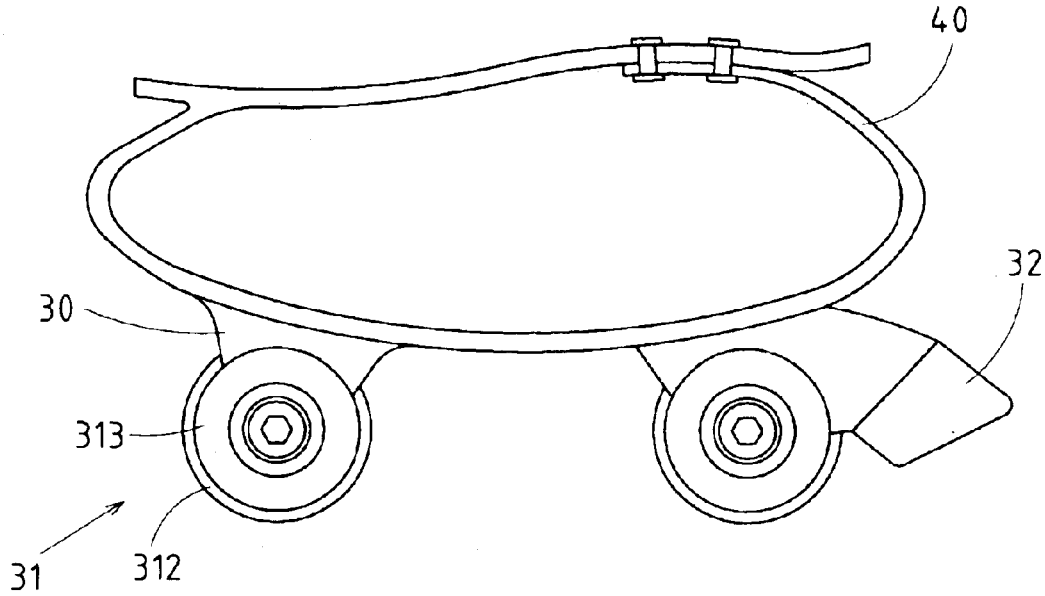
Figure 12:
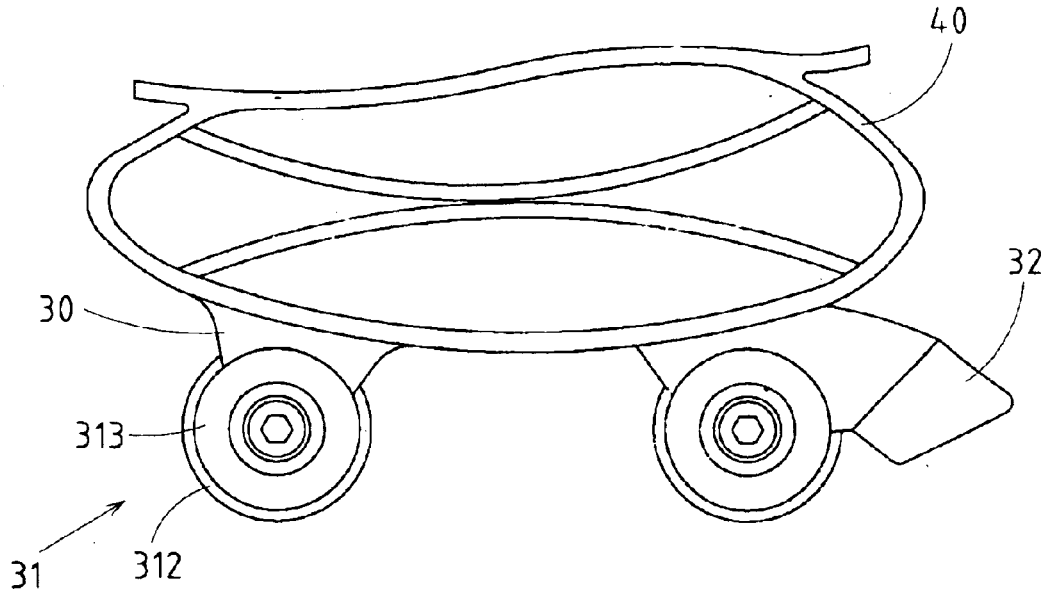
Figure 13:
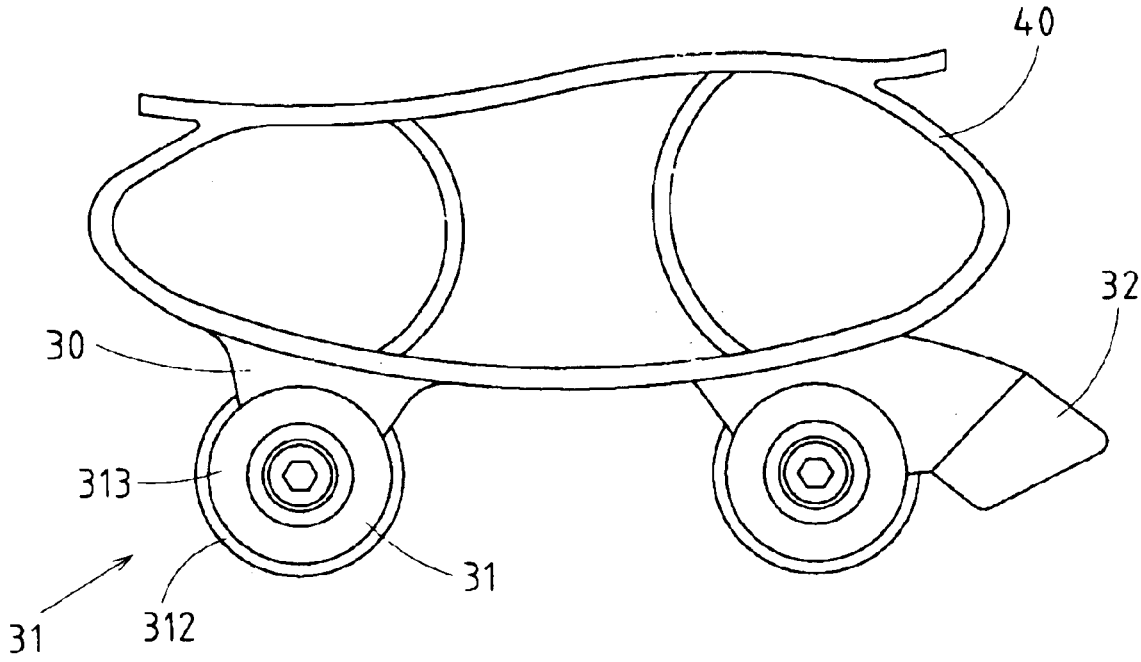
Figure 14:
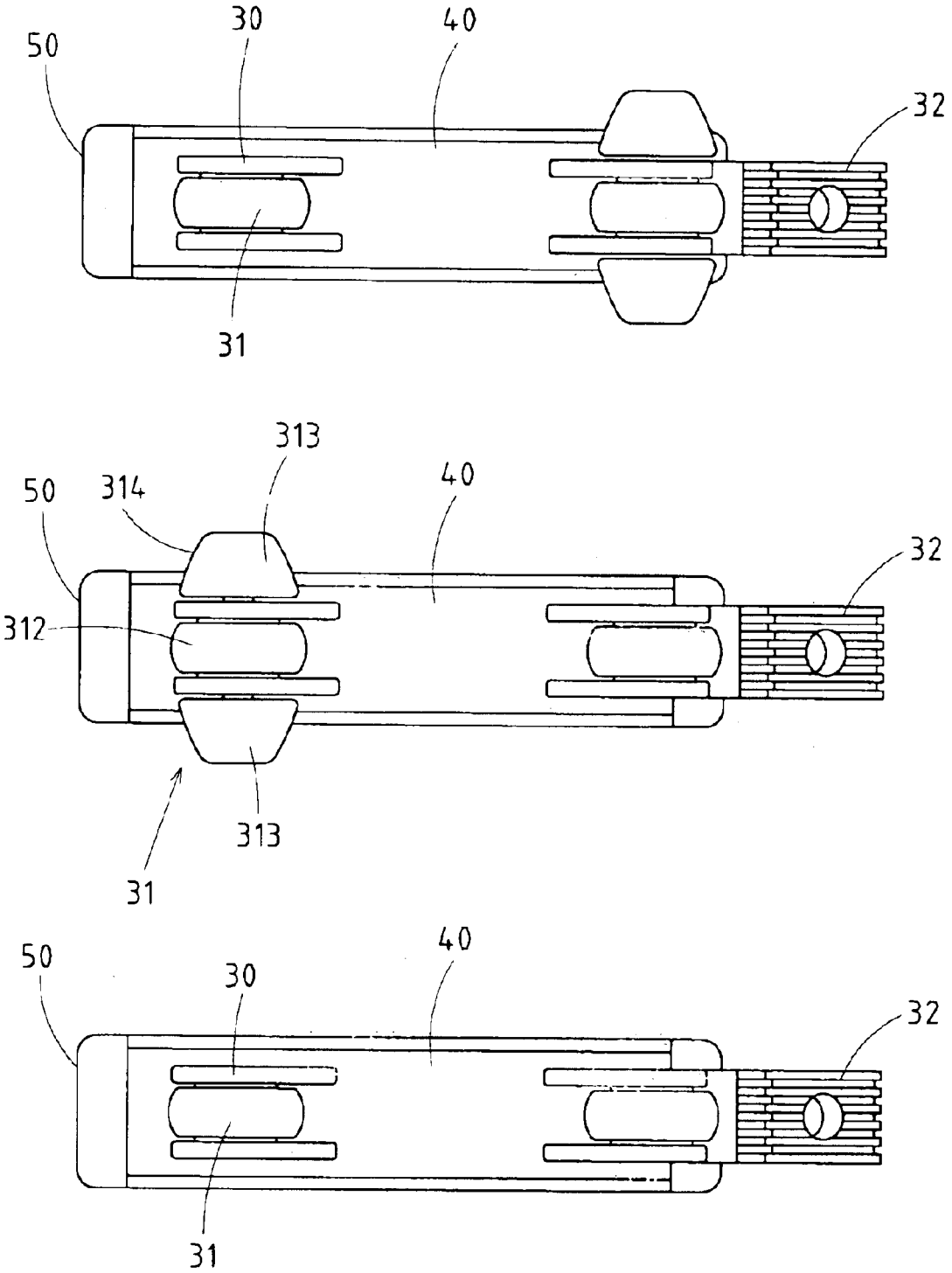
FIG. 14 shows various forms of wheel arrangement of the present invention.

As shown in FIG. 8, a roller skate of the fourth preferred embodiment of the present invention is basically similar in construction to that of the first preferred embodiment, with the difference being that the former comprises an elastic member, which is a tension spring 64 with two hooked ends 641 and 642. The tension spring 64 is horizontally located in the connection frame 40 by two expandable frames 54 and 55 such that the first hooked end 641 of the tension spring 64 is engaged with a first fastening rod 56 of the first expandable frame 54, and that the second hooked end 642 of the tension spring 64 is engaged with a second fastening rod 57 of the second expandable frame 55. The first fastening rod 56 of the first expandable frame 54 is provided with an adjustment portion 561 which is used to adjust the tightness of the tension spring 64.

The elastic member 61, 62, 63, and 64 of the present invention serve as a shock absorber to alleviate the shock wave transmission to the boot 20 from the wheels 31 in motion on a surface.

The embodiments of the present invention described above are to be regarded in all respects as being illustrative and nonrestrictive. Accordingly, the present invention may be embodied in other specific forms without deviating from the spirit thereof. The present invention is therefore to be limited only by the scope of the following claims.

I claim:

1. A roller skate comprising:

a boot;

a connection frame fastened to an outsole of said boot;

an expandable frame fitted to said connection frame, said expandable frame having a locating piece affixed thereto;

a wheel frame fastened to said connection frame, said wheel frame having a plurality of wheels and a brake shoe; and an elastic member having a through slot formed therein, said elastic member positioned in said connection frame by said expandable frame such that said locating piece of said expandable frame is inserted into said through slot of said elastic member, said elastic member being in contact with said connection frame, at times, when the skate is in use.

2. The roller skate of claim 1, wherein said elastic member is a rubber block having said through slot formed therein, said locating piece of said expandable frame being inserted into said through slot of said rubber block so as to position said rubber block in said connection frame.

3. The roller skate of claim 2, wherein said elastic member is a coil spring, said locating piece of said expandable frame being a locating plate which has a through hole formed therein, said through hole confining said coil spring in said connection frame.

4. The roller skate of claim 2, wherein said elastic member is a tension spring with a first hooked end and a second hooked end, said expandable frame being divided into a first expandable frame and a second expandable frame, said first expandable frame having a first fastening rod, said second expandable frame having a second fastening rod, said tension spring positioned in said connection frame by said first expandable frame and said second expandable frame such that said first hooked end of said tension spring is engaged with said first fastening rod of said first expandable frame, said second hooked end of said tension spring is engaged with said second fastening rod of said second expandable frame.

5. The roller skate of claim 4, wherein said first fastening rod of said first expandable frame has an adjusting means thereon, said adjusting means for adjusting a tightness of said tension spring.

6. The roller skate of claim 1, wherein said elastic member is a rubber wheel, said through slot being a locating hole, said expandable frame having a locating pillar whereby said locating pillar is inserted into said locating hole of said rubber wheel so as to position said rubber wheel in said connection frame.

* * * * *